US010384861B2

(12) United States Patent
Chatelain

(10) Patent No.: US 10,384,861 B2
(45) Date of Patent: Aug. 20, 2019

(54) SHOULDER PACK WITH LID LIFT

(71) Applicant: PHILIP MORRIS PRODUCTS S.A., Neuchatel (CH)

(72) Inventor: Lucas Chatelain, Lausanne (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 0 days.

(21) Appl. No.: 15/536,267

(22) PCT Filed: Dec. 15, 2015

(86) PCT No.: PCT/IB2015/059640
§ 371 (c)(1),
(2) Date: Jun. 15, 2017

(87) PCT Pub. No.: WO2016/108120
PCT Pub. Date: Jul. 7, 2016

(65) Prior Publication Data

US 2017/0349362 A1 Dec. 7, 2017

(30) Foreign Application Priority Data

Dec. 30, 2014 (EP) ..... 14200572
Jul. 31, 2015 (EP) ..... 15179421

(51) Int. Cl.
*B65D 85/10* (2006.01)
*B65D 5/52* (2006.01)
(Continued)

(52) U.S. Cl.
CPC ..... *B65D 85/1009* (2013.01); *B65D 5/103* (2013.01); *B65D 5/4266* (2013.01);
(Continued)

(58) Field of Classification Search
CPC .... A47F 7/02; A47F 7/03; B65D 5/10; B65D 5/103; B65D 5/42; B65D 5/4266;
(Continued)

(56) References Cited

U.S. PATENT DOCUMENTS 1,859,401 A 5/1932 Hassberg
2,657,793 A 11/1953 Goldshine
(Continued)

FOREIGN PATENT DOCUMENTS

DE 102013010778 A1 12/2014
EP 2778087 A1 9/2014
(Continued)

OTHER PUBLICATIONS

Office Action for CN 2018580066066.3, issued by the Chinese Patent Office dated Sep. 3, 2018; 19 pgs. Including English Translation.

(Continued)

*Primary Examiner* — Bryon P Gehman
(74) *Attorney, Agent, or Firm* — Mueting, Raasch & Gebhardt, P.A.

(57) ABSTRACT

A container for consumer goods comprises an inner portion received within an outer box portion and a lifting mechanism that facilitates easy access to consumer goods received on or within the inner portion. The lifting mechanism connects the back wall of the inner portion to the lid portion top wall or lid portion front wall. The consumer goods, such as smoking articles, are longitudinally orthogonal to the hinge line.

20 Claims, 6 Drawing Sheets

(51) Int. Cl.
*B65D 5/10* (2006.01)
*B65D 5/42* (2006.01)
*B65D 5/66* (2006.01)

(52) U.S. Cl.
CPC ..... *B65D 5/5213* (2013.01); *B65D 5/6608* (2013.01); *B65D 85/1036* (2013.01)

(58) Field of Classification Search
CPC ..... B65D 5/52; B65D 5/5213; B65D 5/66; B65D 5/6608; B65D 5/72; B65D 85/10; B65D 85/1009; B65D 85/1036; B65D 85/12; A24F 15/16
See application file for complete search history.

(56) References Cited

U.S. PATENT DOCUMENTS 2,680,512 A 6/1954 Young
7,455,182 B2 * 11/2008 Merckell ..... B65D 5/5213 206/250
9,371,151 B2 * 6/2016 Nadeau ..... B65D 5/5213

FOREIGN PATENT DOCUMENTS

GB 349970 A 6/1931
GB 582970 A * 12/1946 ..... B65D 5/4804
WO WO 2011/072806 A1 6/2011
WO WO 2016/107917 A1 7/2016

OTHER PUBLICATIONS

International Search Report and Written Opinion issued by the European Patent Office, for PCT/IB2015/059640, dated Feb. 24, 2016; 12 pgs.
International Preliminary Report on Patentability, issued by the European Patent Office, for PCT/IB2015/059640, dated Dec. 9, 2016; 15 pgs.
International Search Report and Written Opinion issued by the European Patent Office, for PCT/EP2015/081449, dated Feb. 10, 2016; 9 pgs.

* cited by examiner

SHOULDER PACK WITH LID LIFT

This application is the § 371 U.S. National Stage of International Application No. PCT/162015/059640, filed 15 Dec. 2015, which claims the benefit of European Application Nos. 14200572.7, filed 30 Dec. 2014 and 15179421.1, filed 31 Jul. 2015, the disclosures of which are incorporated by reference herein in their entireties.

The present invention relates to a container for consumer goods with an inner portion that articulates with a lifting mechanism. The container finds particular application as a container for elongate smoking articles such as cigarettes.

It is known to package consumer goods such as, for example, elongate smoking articles in containers formed from folded laminar blanks. For example, elongate smoking articles, such as cigarettes and cigars, are commonly sold in hinge-lid packs having a box for housing the smoking articles and a lid connected to an upper portion of the box about a hinge line extending across the back wall of the container. Such hinge-lid packs are typically constructed from one-piece laminar cardboard blanks. An inner frame is often provided and fixed within the box. In use, the lid is pivoted about the hinge line to open the pack, to expose only an end portion of the smoking articles, and to gain access to the smoking articles held within the box.

In some configurations, the box portion of the container may include an inner box received within the outer box of the container. For example, in the design of some shoulder packs the lid opens to reveal an inner box lying within the outer box. The inner box may be hinged at one end with respect to the outer box so that the inner box can be pivoted upwards to allow access to the consumer goods within the inner box. However, in some cases it is difficult for the consumer to pivot the inner box and access the consumer goods. For example, it may be difficult for the consumer to simultaneously hold the outer box, grasp and lift the inner box and remove one or more consumer goods.

It would be desirable to provide a reliable lifting mechanism within a container for consumer goods such as a shoulder pack. It would be desirable that the lifting mechanism independently articulates the inner portion of the container relative to the outer portion of the container once released from the closed position.

According to the present disclosure there is provided a container for consumer goods comprising an inner portion received within an outer box portion and a lifting mechanism that facilitates easy access to consumer goods received on or within the inner portion. The lifting mechanism lifts the inner portion from a top side adjacent the lid hinge line and the inner portion articulates along a hinge line along a bottom side of the container. The consumer goods, such as cigarettes, are longitudinally orthogonal to the hinge line.

The outer box portion has an outer box back wall extending between an outer box left side wall and an outer box right side wall. The outer box bottom wall is orthogonal to the outer box back wall and extends between the outer box left side wall and the outer box right side wall. A lid portion depends from a first hinge line along a top edge of the outer box portion. The lid portion having a lid front wall extending between a lid right side wall and a lid left side wall and a lid bottom wall orthogonal to the lid front wall and extending between the lid left side wall and the lid right side wall. The lid portion is movable about the first hinge line between a closed position and an open position.

An inner portion is configured to receive consumer goods along an open top side. The inner portion is received within the outer box portion. The inner portion comprises an inner portion back wall between an inner portion right side wall and an inner portion left side wall and an inner portion bottom wall orthogonal to the inner portion back wall and extending between the inner portion left side wall and the inner portion right side wall. The inner portion back wall is adjacent to the inner portion back wall when the lid portion is in the closed position. The inner portion bottom wall is adjacent to the outer box bottom wall and the first hinge line is adjacent to the inner portion open top side and the inner portion is hingedly attached to the outer box bottom wall.

A lifting element depends from a first lifting element hinge line along the inner portion back wall and is fixed to the lid portion. The lifting element is adapted to move the inner portion back wall away from the outer portion back wall when the lid portion travels from the closed position to the open position. Advantageously, the shoulder box lifting mechanism articulates the inner portion back wall away from the outer box back wall as the lid portion moves to the open position, ensuring reliable, and consistent articulation of the inner portion.

The lifting element articulates the inner portion relative to the outer box portion along a second hinge line along connecting the inner portion bottom wall and the outer portion bottom wall. The second hinge line is parallel with the first hinge line. The parallel hinge lines provide simple construction and assembly of the shoulder box.

The lifting element can include a second lifting element hinge line separating a first flap and a second flap and a third lifting element hinge line separating the second flap from a third flap. Preferably the lifting element includes a tab cut-out extending along and replacing a portion of the third lifting element hinge line. The tab cut-out creates an audible sound when the second flap and third flap rotate to a non-coplanar configuration. Advantageously this provides an audible sound that indicates an opening or closing position to the consumer.

In many embodiments, the lid portion further comprises a lid top wall extending between the lid right side wall and the lid left side wall and the top wall depends from the first hinge line along a top edge of the outer box bottom wall. Here, the lifting element is fixed to the lid top wall. Preferably the third flap is fixed to the lid top wall and the first hinge line and the third lifting element hinge line are parallel and coextensive. In many of these embodiments, the first flap and second flap are folded onto each other and the third flap is substantially orthogonal to the first flap and second flap when the container is in the closed position and the third flap is coplanar with the lid top wall. In this configuration, the second flap and the third flap are coplanar when the lid is opened to an angle of about at least 45 degrees. Advantageously, this configuration provides a simple construction and early audible sound to indicate that the inner portion is articulating relative to the outer box portion.

In other embodiments, the outer box portion comprises an outer box top wall extending between the outer box right side wall and the outer box left side wall and the lid front wall depends from the first hinge line along the outer box top wall. Here the third flap is fixed to and coplanar with the lid front wall and the second flap and the third flap are coplanar when the lid is opened to an angle of about at least 180 degrees. Advantageously, this configuration provides a simple construction and audible sound to indicate that the inner portion is articulating relative to the outer box portion. Additionally this container can be opened even if the container back wall is laying on a substrate.

Either a top side portion of the outer box left side wall and the outer box right side wall can have a curved corner or the bottom side portion of the lid left side wall and the outer box right side wall have a curved corner. This feature provides the advantage that the lid and the outer box side walls do not contact each other when the container is closed to provide a smooth closing action for the container.

The consumer goods received within the inner portion are elongated elements having a longitudinal axis that is orthogonal to the first hinge line. The inner portion can further include an inner portion front wall extending between the inner portion right side wall and the inner portion left side wall and the inner portion front wall is parallel to the inner portion back wall. The inner portion front wall advantageously retains the elongated consumer goods within the inner portion.

In many embodiments, the first hinge line connects the outer box to the lid portion. The outer box portion and lid portion are formed of the same laminar blank. This construction advantageously simplifies construction and assembly of the book box.

In many embodiments, the inner portion and the lifting mechanism are formed of the same laminar blank. This construction advantageously simplifies construction and assembly of the book box.

The present invention is applicable to any suitable container for consumer goods that includes an inner package. It is known to package consumer goods such as, for example, elongate smoking articles in containers formed from folded laminar blanks. For example, elongate smoking articles, such as cigarettes and cigars, are commonly sold in hinge-lid packs having a box for housing the smoking articles and a lid connected to the box about a hinge line extending across the back wall of the container. The box may include a box back wall, a box right side wall, a box top wall, and a box bottom wall. The lid may form the box front wall and the box left side wall.

The terms "front," "back," "upper," "lower," "side," "top," "bottom," and other terms used to describe relative positions of the components of containers refer to the container where the lid forms a front side and the consumer good lay along a back side. The terms "left" and "right" can be used with reference to side walls of the container when the container is viewed from the front side. When describing containers according to the present invention, these terms are used irrespective of the orientation of the container being described. The lid portion hinge line that allows opening the lid portion of the container by a pivotal movement is located at the "back" of the container. Converserly, the "front" of the container refers to the side of the container opposite the "back" of the container.

The term "inner surface" is used throughout the specification to refer to the surface of a component of the assembled container that is facing towards the interior of the container, for example towards the consumer goods, when the container is in the closed position.

The term "outer surface" is used throughout the specification to refer to the surface of a component of the container that is facing towards the exterior of the container. For example, in one or more embodiments, the container includes an inner portion that includes an outer surface that is facing the outer box portion of the container and an inner surface that is facing the consumer goods held in the container.

The term "hinge line" refers to a line about which two elements can be pivoted relative to each other. A hinge line may be, for example, a fold line, a perforation line or score line in a wall or panel of the container, or between two walls of the container.

The term "panel" refers to a portion of the container formed from a single, continuous portion of material. A panel can depend along one or more fold lines form one or more other panels. The term "flap" refers to a panel that depends along only one fold line from only one other panel.

The term "wall" refers to a facet of the container, and a wall can be formed from a single panel or flap, or a wall can be formed from two or more abutting or overlapping panels or flaps.

The terms "height", "width" and "depth" refer to the external dimensions of the container or a component of the container along three perpendicular axes, when the lid is in the closed position and viewing the container from the front side. For example, the "height" of the container refers to the vertical distance between the top and bottom of the container, the "width" of the container refers to the distance between opposed right and left sides of the container, and the "depth" of the container refers to the distance between the front and back of the container. The terms "internal height", "internal width" and "internal depth" refer to corresponding dimensions inside the container or component. The difference between the external dimensions of the container and the internal dimensions of the container is determined by the thickness of the material, the number of layers and additional elements, like for example, the thickness of an adhesive.

According to the present disclosure there is provided a container for consumer goods comprising an inner portion received within an outer box portion and a lifting mechanism that facilitates easy access to consumer goods received on or within the inner portion. The lifting mechanism lifts the inner portion from a top side adjacent the lid portion and the inner portion articulates along a hinge line along a bottom side of the container.

The outer box portion has an outer box back wall extending between an outer box left side wall and an outer box right side wall. An outer box bottom wall is orthogonal to the outer box back wall and extends between the outer box left side wall and the outer box right side wall. In some embodiments, the outer box portion includes an outer box top wall extending between the outer box left side wall and the outer box right side wall and is orthogonal to the outer box back wall.

A lid portion depends from a first hinge line along a top edge of the outer box. The first hinge line forms an edge or corner of the container described herein. The lid portion includes a lid front wall extending between a lid right side wall and a lid left side wall. A lid bottom wall is orthogonal to the lid front wall and extends between the lid left side wall and the lid right side wall. The lid portion is movable about the first hinge line between a closed position and an open position. Preferably the outer box portion and the lid portion are formed from the same laminar blank.

An inner portion for receiving consumer goods along an open top side is received within the outer box portion. The inner portion includes an inner portion back wall between an inner portion right side wall and an inner portion left side wall. An inner portion bottom wall is orthogonal to the inner portion back wall and extends between the inner portion left side wall and the inner portion right side wall. The inner portion back wall is adjacent to the inner portion back wall when the lid portion is in the closed position. The inner portion bottom wall is adjacent to the outer box bottom wall and the first hinge line is adjacent to the inner portion open top side and the inner portion is hingedly attached to the outer box bottom wall.

A lifting element depends from a first lifting element hinge line along the back wall of the inner portion and is fixed to the lid portion. The lifting element is adapted to move the inner portion back wall away from the outer portion back wall when the lid portion travels from the closed position to the open position. Preferably the inner portion and the lifting element are formed from the same laminar blank.

In many embodiments, the lifting element is a folded substrate element. The lifting element can include a second lifting element hinge line separating a first flap and a second flap and a third lifting element hinge line separating the second flap from a third flap. The folded substrate element can be formed of any material such as paper having a basis weigh from about 60 grams/$m^2$ to about 200 grams/$m^2$. Preferably, the prominent grain direction is orthogonal to the fold lines to maximize the shape memory of the lifting element.

Preferably the lifting element includes a tab cut-out extending along and replacing a portion of the third lifting element hinge line. The tab cut-out creates an audible sound when the second flap and third flap rotate to a non-coplanar configuration. The tab-cut-out has an elongated "U" shape. The tab cut-out can have replace from about 20 percent to about 50 percent of the total length of the third lifting element hinge line. The tab cut-out can have a length of about 10 mm to about 35 mm, more preferably about 15 mm to about 20 mm. The tab cut-out can have a height (off-set distance from the third lifting element hinge line) of between about 1 mm to about 10 mm, more preferably between about 2 mm to about 4 mm.

In some embodiments, the lid portion depends from a first hinge line along a top edge of the outer box back wall and the lid portion includes a lid top wall extending between the lid left side wall and the lid right side wall. In these embodiments, the lifting element is fixed to the lid top wall. Preferably the third flap is fixed to the lid top wall and the first hinge line and the third lifting element hinge line are parallel and coextensive. In many of these embodiments, the first flap and second flap fold onto each other and the third flap is substantially orthogonal to the first flap and second flap when the container is in the closed position and the third flap is coplanar with the lid top wall. In this configuration, the second flap and the third flap are coplanar when the lid opens to an angle of about at least 90 degrees.

In other embodiments, the outer box portion includes an outer box top wall extending between the outer box right side wall and the outer box left side wall and the lid front wall depends from the first hinge line along the outer box top wall. Here the lifting mechanism is fixed to and coplanar with the lid front wall. In these embodiments, the lifting element can have five flaps and five fold lines, where the first flap depends from the inner portion and each subsequent flap depends from the preceding flap. The fourth flap can be fixed to and planar with the lid front wall. The fifth flap is folded back onto the fourth flap and provides a lever action force back onto the third flap during the closing movement to allow the lifting element to fold upon itself smoothly. The second flap folds onto the first flap in the closed position.

This configuration provides a first and second bi-stable position for the inner portion when opening the container. Once the lid is opened more than about 90 degrees, for example, the inner portion "pops" or springs away from the outer box portion from the first bi-stable position to the second bi-stable position. Closing the lid portion to an angle less than about 180 degrees causes the lever flap or fifth flap to contact and deflect the third flap and allow the lifting mechanism to close or fold upon itself moving back from the second bi-stable position to the first bi-stable position.

in some embodiments, it is preferred that a top side portion of the outer box left side wall and the outer box right side wall have a curved corner. In other embodiments, it is preferred that the bottom side portion of the lid left side wall and the outer box right side wall have a curved corner. Both versions can improve a smooth closing of the container and prevent straight edges from catching and jamming during the closing movement.

The container, outer box portion, lid portion and inner portion and outer wrapper may be formed from any suitable materials including, but not limited to, cardboard, paperboard, plastic, metal, or combinations thereof. The cardboard may have a weight of between about 100 grams per square meter and about 350 grams per square meter.

The consumer goods within the container may be wrapped in an inner liner. The inner liner and consumer goods together form an inner package. Prior to first opening, the filled container may be wrapped in an outer wrapper.

Containers according to the invention may be in the shape of a rectangular parallelepiped, with right-angled longitudinal and right-angled transverse edges. Alternatively, the container may include one or more rounded longitudinal edges, rounded transverse edges, bevelled longitudinal edges, or bevelled transverse edges, or combinations thereof. For example, the container according to the invention may include, without limitation, one or more of the following features:

- one or two longitudinal rounded or bevelled edges on at least one of the lid wall (or front wall) and the outer box back wall;
- one or two transverse rounded or bevelled edges on at least one of the lid (or front wall) and the outer box back wall;
- one longitudinal rounded edge and one longitudinal bevelled edge on the lid (or front wall), or one transverse rounded edge and one transverse bevelled edge on the outer box back wall;
- one longitudinal rounded edge and one longitudinal bevelled edge on the lid (or front wall), and one transverse rounded edge and one transverse bevelled edge on the outer box back wall;
- one or two transverse rounded or bevelled edges on the lid (or front wall) and one or two longitudinal rounded or bevelled edges on the lid (or front wall); and
- two longitudinal rounded or bevelled edges on a right side wall or two transverse rounded or bevelled edges on the left side wall.

Where the container includes one or more rounded edges, preferably the blanks forming the container (outer box and lid) include three, four, five, six, or seven scoring lines or creasing lines to form each rounded edge in the assembled container. The scoring lines or creasing lines may be either on the inside of the container or on the outside of the container. Preferably, the scoring lines or creasing lines are spaced from each other by between about 0.3 mm and about 4 mm.

As well as housing a bundle of smoking articles, the container may further include other consumer goods, for example, matches, lighters, extinguishing means, breath-fresheners, or electronics. The other consumer goods may be attached to the outside of the container, contained within the container along with the smoking articles, in a separate compartment of the container, or combinations thereof.

The exterior surfaces of containers according to the invention may be printed, embossed, debossed or otherwise embellished with manufacturer or brand logos, trade marks, slogans and other consumer information and indicia.

A carton that includes a lid and at least one sidewall can contain multiple containers as described herein.

Referring now to the drawings, in which some aspects of the present invention are illustrated FIG. 1 is a schematic perspective view of a container in an open position, where the container includes an outer box portion and an inner portion disposed within the outer box portion.

Figure 1:
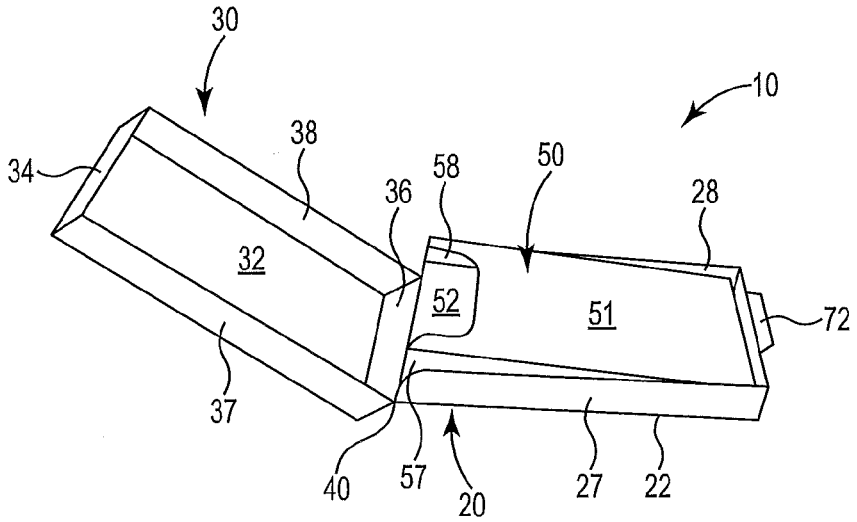

FIG. 1 shows a container 10 according to an embodiment of the invention. The container 10 comprises an outer box portion 20, an inner portion 50 and a lid portion 30. A lifting mechanism articulates the inner portion 50 away from the outer box portion 20 once the lid portion 30 is moved toward the open position. The lifting mechanism is omitted from FIG. 1 for clarity, but is shown in and described with reference to FIGS. 3 and 4.

The outer box portion 20 includes an outer box back wall 22 extending between an outer box left side wall 27 and an outer box right side wall 28. The outer box bottom wall 24 is orthogonal to the outer box left side wall 27 and outer box right side wall 28 and extends between the outer box left side wall 27 and outer box right side wall 28.

The lid portion 30 includes a lid front wall 32 extending between a lid bottom wall 34 and lid top wall 36 and between a lid right side wall 38 and lid left side wall 37. The lid right side wall 38 and left side wall 37 are orthogonal to the lid front wall 32 and extend between the lid bottom wall 34 and lid top wall 36.

The lid portion 30 depends from a first hinge line 40 along a top side of the outer box portion back wall 22. The lid portion 30 is movable about the first hinge line 40 between a closed position and an open position. The first hinge line 40 extends between the outer box left side wall 27 and the outer box right side wall 28.

Figure 2:
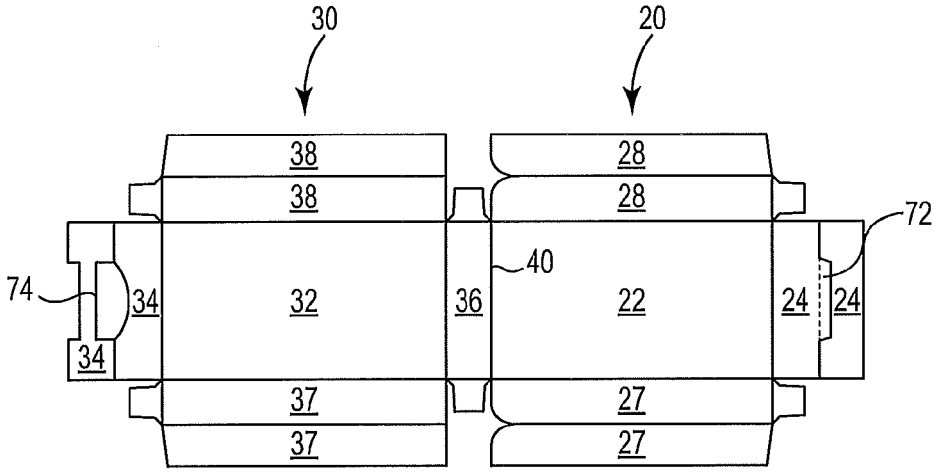
FIG. 2 is a schematic diagram of a single laminar blank forming the outer box portion and the lid portion.

The outer box portion 20 and the lid portion 30 are preferably formed from a single laminar blank as illustrated in FIG. 2. A top portion of the outer box left side wall 27 and an outer box right side wall 28 preferably has a curved corner to provide ease of closure and reduce the incidence of the lid portion 30 catching on the outer box left side wall 27 and an outer box right side wall 28 during the closing movement of the lid portion 30.

The inner portion 50 is arranged and configured to receive consumer goods. The consumer goods can have a longitudinal length that is generally orthogonal with the first hinge line 40. In many embodiments, the consumer goods are elongated articles such as smoking articles or cigarettes, where the longitudinal length or axis is generally orthogonal with the first hinge line 40. The consumer goods can be extracted from the inner portion 50 top side.

The inner portion 50 is received within the outer box portion 20. The inner portion 50 comprises an inner portion back wall 52 that extends between an inner portion right side wall 58 and an inner portion left side wall 57. Preferably the inner portion 50 comprises an inner portion front wall 51 that extends between an inner portion right side wall 58 and an inner portion left side wall 57 and is parallel with the inner portion back wall 52. A top side portion of the inner portion 50 is open to provide access to the consumer goods held within the inner portion 50.

Figure 3:
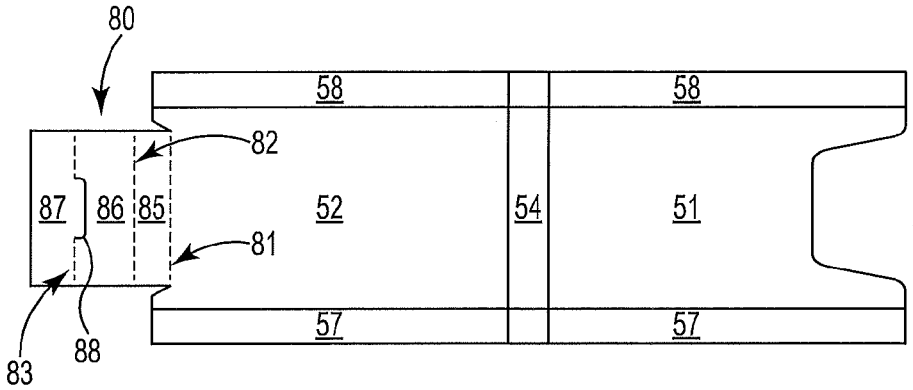
FIG. 3 is a schematic diagram of a single laminar blank for forming the inner portion and an exemplary lifting element.
Figure 4:
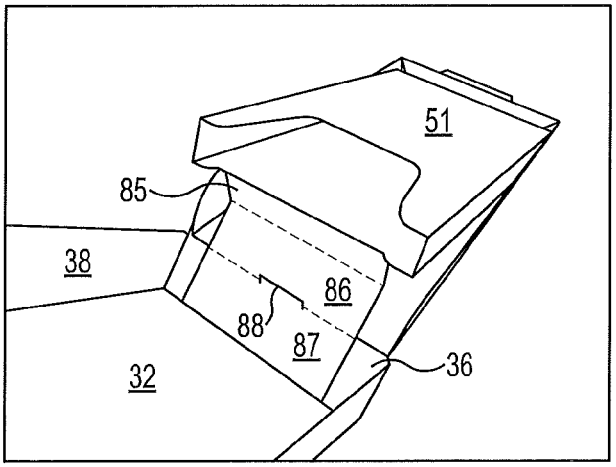
FIG. 4 is a schematic perspective top view of the container of FIG. 1 in the open position showing the lifting mechanism fixed to the top wall of the lid.
Figure 5:
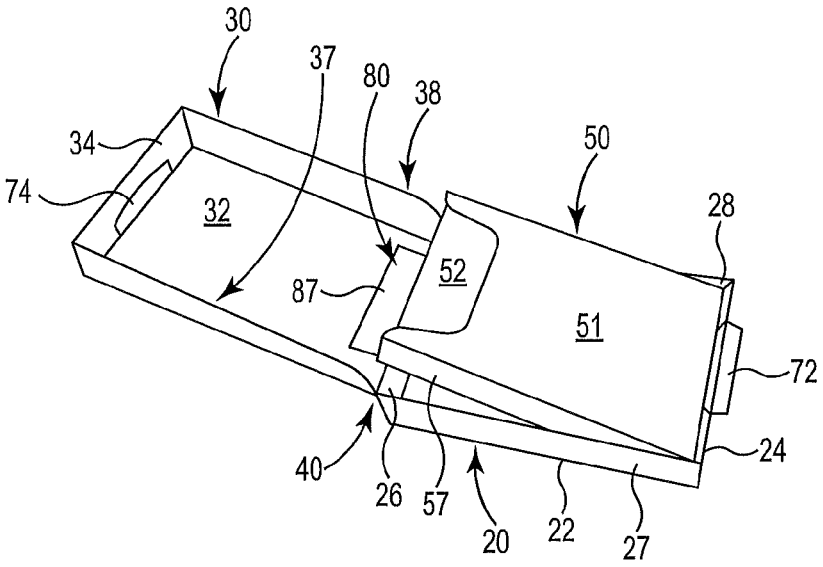
FIG. 5 is a schematic perspective view of another embodiment of the container in an open position, where the lifting element is fixed to the front wall of the lid.

The inner portion back wall 52 is adjacent to the outer box back wall 22 when the lid portion 30 is in the closed position. The outer box portion bottom wall 24 is between and adjacent to the inner portion bottom wall 54 and the lid bottom wall 34. For ease of construction, the inner portion 50 and the lifting element 80 are formed from the same laminar blank as illustrated in FIG. 3. The inner portion bottom wall 54 is hingedly attached to the outer box portion bottom wall 24 along a second hinge line. Preferably the second hinge line is parallel with the first hinge line 40.

FIG. 3 illustrates the lifting element 80 depending from the inner portion back wall 52 along a lifting element first fold line 81. A first lifting element flap 85 connects to the inner portion back wall 52 along the lifting element first fold line 81. A second lifting element flap 86 connects to the first lifting element flap 85 along a lifting element second fold line 82. A third lifting element flap 87 connects to the second lifting element flap 86 along a lifting element third fold line 83.

The third lifting element flap 87 is fixed to the lid portion 30 to articulate the inner portion 50 relative to the outer box portion 20 when the lid portion 30 is moved to the open position. The lifting element 80 moves the inner portion back wall 52 away from the outer box back wall 22 when the lid portion 30 travels to the open position.

FIG. 1 to FIG. 4 illustrate one embodiment of the container where the lid portion 30 has a top lid wall 36 extending between the lid right side wall 38 and the lid left side wall 37. The lid top wall 36 depends from the first hinge line 40 along a top edge of the outer box bottom wall 22. The lifting element 80 is fixed to the lid top wall 36. The third lifting element flap 87 is fixed to the lid top wall 36. The first hinge line 40 and the third lifting element hinge line 83 are parallel and preferably coextensive. The first flap 85 and second flap 86 are folded onto each other and the third flap 87 is substantially orthogonal to the first flap 85 and second flap 86 when the container is in the closed position. The third flap 87 is coplanar with the lid top wall 36. In many of these embodiments, a top side portion of the outer box left side wall 27 and the outer box right side wall 28 have a curved corner.

The container 10 further includes a locking element 72 on the outer box bottom wall 24 configured to engage a lid portion lock-mating element 74 on the lid portion bottom wall 34 and secure the lid 30 in the closed position.

FIG. 5 to FIG. 10 illustrates another embodiment of the container where the outer box portion 20 has an outer box top wall 26 extending between the outer box right side wall 28 and the outer box left side wall 27. The lid front wall 32 depends from the first hinge line 40 along the outer box top wall 26. The lifting element 80 is fixed to the lid front wall 32. In many of these embodiments, a bottom side portion of the lid left side wall 37 and the lid right side wall 38 have a curved corner.

The outer box portion 20 includes an outer box back wall 22 extending between an outer box left side wall 27 and an outer box right side wall 28. The outer box bottom wall 24 is orthogonal to the outer box left side wall 27 and outer box right side wall 28 and extends between the outer box left side wall 27 and outer box right side wall 28. An outer box top wall 26 is orthogonal to the outer box left side wall 27 and outer box right side wall 28 and extends between the outer box left side wall 27 and outer box right side wall 28.

The lid portion 30 includes a lid front wall 32 extending between a lid right side wall 38 and lid left side wall 37. The lid right side wall 38 and left side wall 37 are orthogonal to the lid front wall 32 and a lid bottom wall 34 extends between a lid right side wall 38 and lid left side wall 37.

The lid portion 30 depends from a first hinge line 40 along a top wall 26 of the outer box portion back wall 22. The lid portion 30 is movable about the first hinge line 40 between a closed position and an open position. The first hinge line 40 extends between the outer box left side wall 27 and the outer box right side wall 28.

Figure 6:
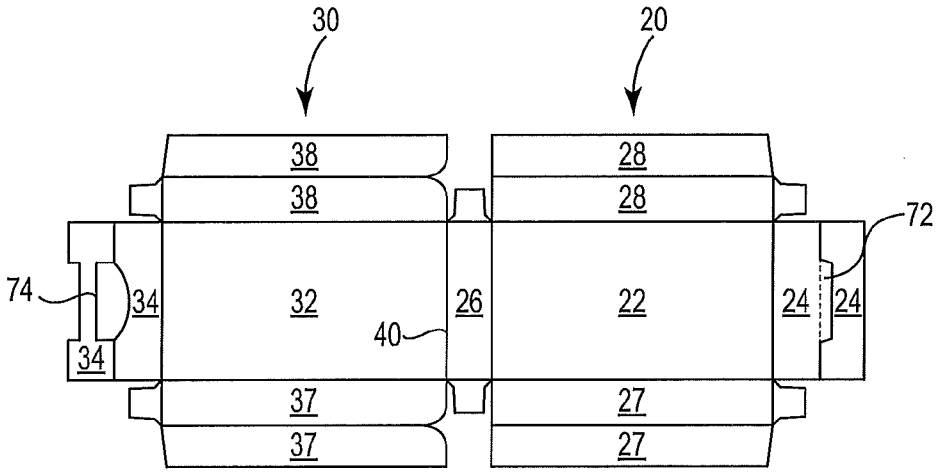
FIG. 6 is a schematic diagram of another single laminar blank forming the outer box portion and the lid portion.

The outer box portion 20 and the lid portion 30 are preferably formed from a single laminar blank as illustrated in FIG. 6. A bottom portion of the lid left side wall 37 and the lid right side wall 38 preferably has a curved corner to provide ease of closure and reduce the incidence of the lid portion 30 catching on the outer box left side wall 27 and an outer box right side wall 28 during the closing movement of the lid portion 30.

The inner portion 50 is arranged and configured to receive consumer goods as described above.

The inner portion 50 is received within the outer box portion 20. The inner portion 50 comprises an inner portion back wall 52 that extends between an inner portion right side wall 58 and an inner portion left side wall 57. Preferably the inner portion 50 comprises an inner portion front wall 51 that extends between an inner portion right side wall 58 and an inner portion left side wall 57 and is parallel with the inner portion back wall 52. A top side portion of the inner portion 50 is open to provide access to the consumer goods held within the inner portion 50.

Figure 7:
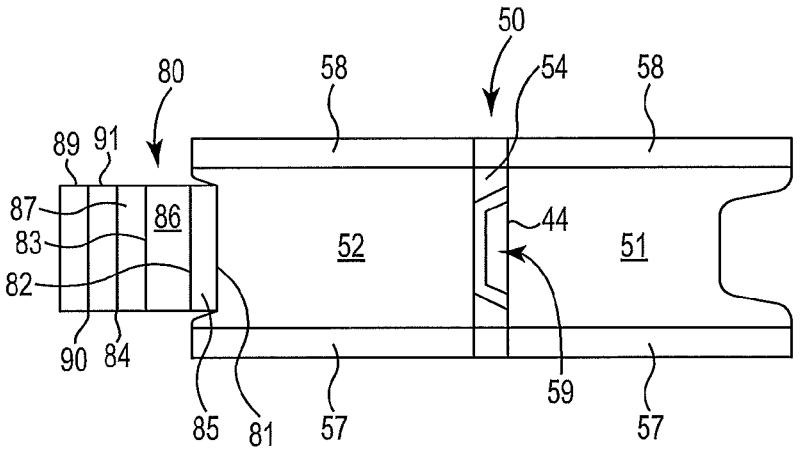
FIG. 7 is a schematic diagram of another single laminar blank for forming the inner portion and another exemplary lifting element.

The inner portion back wall 52 is adjacent to the outer box back wall 22 when the lid portion 30 is in the closed position. The outer box portion bottom wall 24 is between and adjacent to the inner portion bottom wall 54 and the lid bottom wall 34. For ease of construction, the inner portion 50 and the lifting element 80 are formed from the same laminar blank as illustrated in FIG. 7. The inner portion bottom wall 54 is hingedly attached to the outer box portion bottom wall 24 along a second hinge line. Preferably the second hinge line is parallel with the first hinge line 40.

FIG. 7 illustrates the lifting element 80 depending from the inner portion back wall 52 along a lifting element first fold line 81. A first lifting element flap 85 connects to the inner portion back wall 52 along the lifting element first fold line 81. A second lifting element flap 86 connects to the first lifting element flap 85 along a lifting element second fold line 82. A third lifting element flap 87 connects to the second lifting element flap 86 along a lifting element third fold line 83. A fourth lifting element flap 91 connects to the third lifting element flap 87 along a lifting element fourth fold line 84. A fifth lifting element flap 89 connects to the fourth lifting element flap 91 along a lifting element fifth fold line 90.

The fourth lifting element flap 91 is fixed to the lid portion 30 front wall 32 to articulate the inner portion 50 relative to the outer box portion 20 when the lid portion 30 is moved to the open position. The lifting element 80 moves the inner portion back wall 52 away from the outer box back wall 22 when the lid portion 30 travels to the open position.

Figure 8:
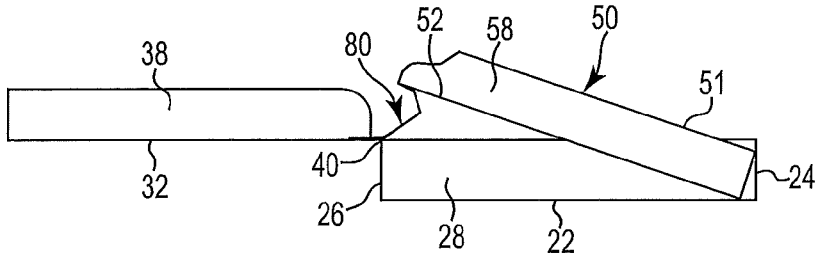
FIG. 8 is a schematic cross-sectional view of the container of FIG. 5.
Figure 9:
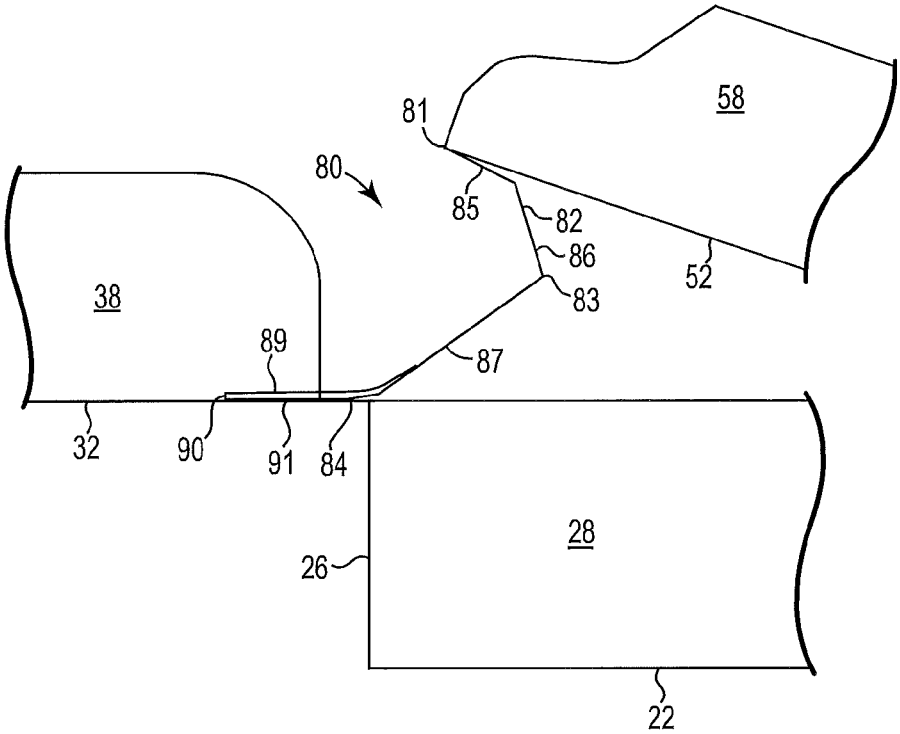
FIG. 9 is a schematic cross-sectional close-up view of the lifting mechanism of FIG. 8.
Figure 10:
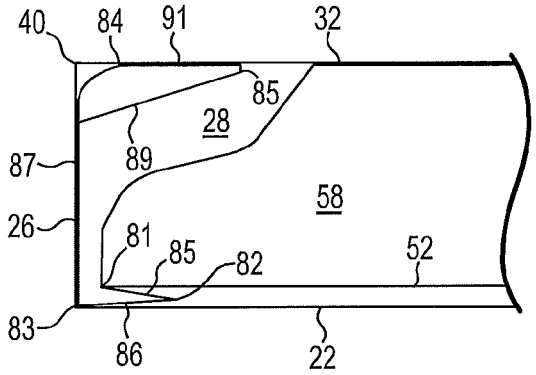
FIG. 10 is a schematic cross-sectional close-up view of the lifting mechanism of FIG. 8 in the closed position.

FIG. 5 to FIG. 10 illustrate one embodiment of the container where the lifting element 80 is fixed to the lid front wall 32. FIG. 8 and FIG. 9 illustrate this five-fold lifting element construction in the open position and FIG. 10 illustrate this five-fold lifting element construction in the closed position. The fourth flap 91 is fixed to and planar with the lid front wall 32. The fifth flap 89 is folded back onto the fourth flap 91 and provides a lever action force back onto the third flap 87 during the closing movement to allow the lifting mechanism 80 to close smoothly. The second flap 86 folds onto the first flap 85 in the closed position.

This configuration provides a first and second bi-stable position for the inner portion 50 when opening the container. Once the lid 30 is opened more than about 90 degrees, for example, the inner portion "pops" or springs away from the outer box portion 20. Closing the lid portion 30 to an angle less than about 180 degrees causes the lever flap or fifth flap 89 to contact and deflect the third flap 87 and allow the lifting mechanism to close or fold upon itself smoothly. Thus the lever or fifth flap 89 is longer than fourth flap 91.

The exemplary embodiments described above are not limiting. Other embodiments consistent with the exemplary embodiments described above will be apparent to those skilled in the art.

The invention claimed is:

1. A container for consumer goods, comprising:

an outer box portion having an outer box back wall extending between an outer box left side wall and an outer box right side wall and an outer box bottom wall orthogonal to the outer box back wall and extending between the outer box left side wall and the outer box right side wall;

a lid portion depending from a first hinge line along a top edge of the outer box portion, the lid portion having a lid front wall extending between a lid right side wall and a lid left side wall and a lid bottom wall being orthogonal to the lid front wall and extending between the lid left side wall and the lid right side wall, the lid portion movable about the first hinge line between a closed position and an open position;

an inner portion for receiving consumer goods along an open top side is received within the outer box portion, the inner portion comprising an inner portion back wall between an inner portion right side wall and an inner portion left side wall and an inner portion bottom wall orthogonal to the inner portion back wall and extending between the inner portion left side wall and the inner portion right side wall, the inner portion back wall adjacent to the inner portion back wall when the lid portion is in the closed position, the inner portion bottom wall is adjacent to the outer box bottom wall and the first hinge line is adjacent to the inner portion open top side and the inner portion is hingedly attached to an inner surface of the outer box bottom wall; and a lifting element depending from a first lifting element hinge line along the back wall of the inner portion and fixed to the lid portion, the lifting element adapted to move the inner portion back wall away from the outer portion back wall when the lid portion travels from the closed position to the open position.

2. The container of claim 1, wherein the lifting element articulates the inner portion relative to the outer box portion along a second hinge line connecting the inner portion bottom wall and the outer box bottom wall, and the second hinge line is parallel with the first hinge line.

3. The container according to claim 2, wherein consumer goods received within the inner portion are elongated elements having a longitudinal axis that is orthogonal to the first hinge line.

4. The container according to claim 2, wherein the lifting element comprises a second lifting element hinge line separating a first flap and a second flap and a third lifting element hinge line separating the second flap from a third flap.

5. The container according to claim 2, wherein the outer box portion comprises an outer box top wall extending between the outer box right side wall and the outer box left side wall and the lid front wall depends from the first hinge line along the outer box top wall, and the lifting element comprises a second lifting element hinge line separating a first flap and a second flap and a third lifting element hinge line separating the second flap from a third flap and a fourth lifting element hinge line separating the third flap from a fourth flap and a fifth lifting element hinge line.

6. The container according to claim 1, wherein consumer goods received within the inner portion are elongated elements having a longitudinal axis that is orthogonal to the first hinge line.

7. The container according to claim 1, wherein the lifting element comprises a second lifting element hinge line separating a first flap and a second flap and a third lifting element hinge line separating the second flap from a third flap.

8. The container according to claim 7, further comprising a tab cut-out extending along and replacing a portion of the third lifting element hinge line, the tab cut-out creates an audible sound when the second flap and third flap rotate to a non-coplanar configuration.

9. The container of claim 8, wherein the lid portion further comprises a lid top wall extending between the lid right side wall and the lid left side wall and the top wall depends from the first hinge line along a top edge of the outer box bottom wall, and wherein the lifting element is fixed to the lid top wall.

10. The container according to claim 9, wherein the third flap is fixed to the lid top wall and wherein the first hinge line and the third lifting element hinge line are parallel and coextensive.

11. The container according to claim 9, wherein the first flap and second flap are folded onto each other and the third flap is substantially orthogonal to the first flap and second flap when the container is in the closed position and wherein the third flap is coplanar with the lid top wall.

12. The container according to claim 9, wherein the second flap and the third flap are coplanar when the lid is opened to an angle of about at least 90 degrees.

13. The container according to claim 9, wherein the first lifting element hinge line and the second hinge line are parallel with the first hinge line.

14. The container according to claim 10, wherein the first lifting element hinge line and the second hinge line are parallel with the first hinge line.

15. The container according to claim 10, wherein the first flap and second flap are folded onto each other and the third flap is substantially orthogonal to the first flap and second flap when the container is in the closed position and wherein the third flap is coplanar with the lid top wall.

16. The container according to claim 1, wherein a top side portion of the outer box left side wall and the outer box right side wall have a curved corner.

17. The container according to claim 1, wherein the outer box portion comprises an outer box top wall extending between the outer box right side wall and the outer box left side wall and the lid front wall depends from the first hinge line along the outer box top wall, and the lifting element comprises a second lifting element hinge line separating a first flap and a second flap and a third lifting element hinge line separating the second flap from a third flap and a fourth lifting element hinge line separating the third flap from a fourth flap and a fifth lifting element hinge line separating the fourth flap from a fifth flap and the fourth flap is fixed and coplanar with the lid front wall and the fifth flap is folded back onto the fourth flap.

18. The container according to claim 17, wherein the fifth flap contacts and defects the third flap when the lid portion is closed to an angle of less than about 180 degrees.

19. The container according to claim 1, wherein the outer box portion and lid portion are formed of a single laminar blank.

20. The container according to claim 1, wherein the inner portion and lifting element are formed of a single laminar blank.

* * * * *